United States Patent [19]

Mori et al.

[11] Patent Number: 4,701,272

[45] Date of Patent: Oct. 20, 1987

[54] SILICONE GREASE COMPOSITION

[75] Inventors: Shigeru Mori; Takayuki Takahashi, both of Gunma, Japan

[73] Assignee: Shin-Etsu Chemical Co., Ltd., Tokyo, Japan

[21] Appl. No.: 849,477

[22] Filed: Apr. 8, 1986

[30] Foreign Application Priority Data

Apr. 24, 1985 [JP] Japan ..... 60-87788

[51] Int. Cl.[4] ..... C10M 113/12

[52] U.S. Cl. ..... 252/28; 252/21

[58] Field of Search ..... 252/28, 21

[56] References Cited

U.S. PATENT DOCUMENTS 2,818,385 12/1957 Alexander ..... 252/28
2,863,846 12/1958 Tyler ..... 252/28
3,037,933 6/1962 Wright ..... 252/28
3,518,188 6/1970 Pirson ..... 252/28
3,770,633 11/1973 Holley et al. ..... 252/28
3,933,678 1/1976 Graham ..... 252/582

*Primary Examiner*—William R. Dixon, Jr.
*Assistant Examiner*—Ellen M. McAvoy
*Attorney, Agent, or Firm*—Jules E. Goldberg

[57] ABSTRACT

The silicone grease composition is highly light-transmitting and very stable with little oil separation. The grease composition is compounded with (a) a methyl phenyl polysiloxane having a specific phenyl content, (b) a fumed silica filler having a specific surface area of at least 130 $m^2/g$ and (c) an alkoxy-containing organosilane compound such as vinyl trimethoxy silane, 3-methacryloxypropyl trimethoxy silane, dimethyl dimethoxy silane and the like in a specified proportion.

6 Claims, 3 Drawing Figures

SILICONE GREASE COMPOSITION

BACKGROUND OF THE INVENTION

The present invention relates to a silicone grease composition or, more particularly, to a silicone grease composition having high stability and transparency with at least 90% of light transmission through a layer of 10 mm thickness over the whole wave length region of visible light.

Conventional silicone grease compositions having high transparency usually comprise a methyl phenyl polysiloxane and a fumed silica filler having a refractive index close to that of the siloxane as the base ingredients with admixture of several kinds of additives including an oxyalkylene, polyoxyalkylene, hydroxy-terminated methyl phenyl polysiloxane of the formula HO—SiMe-Ph—$O_n$H, in which Me and Ph denote methyl and phenyl groups, respectively, and n is a positive integer. Light-transmitting silicone grease compositions of another class known in the prior art include those compounded with a dimethyl polysiloxane and a silica filler surface-treated with an organosilicon compound such as hexamethyl disilazane and the like.

These prior art silicone grease compositions, however, are not quite satisfactory in respect of the light transmission therethrough and it is a rather difficult matter to reproducibly obtain a highly light-transmitting silicone grease composition capable of giving at least 90% of light transmission through a layer of 10 mm thickness over the whole wave length region of visible light and still having good stability as a grease with little separation of the base oil and the thickening components.

SUMMARY OF THE INVENTION

Thus, the highly light-transmitting silicone grease composition with stability provided by the present invention comprises:

(a) 100 parts by weight of a methyl phenyl polysiloxane having a viscosity in the range from 100 to 500,000 centistockes at 25° C. and containing from 5 to 20% by moles of phenyl groups based on the overall amount of the organic groups bonded to the silicon atoms;

(b) from 1 to 30 parts by weight of a fumed silica filler having a specific surface area of at least 130 $m^2/g$; and (c) from 0.1 to 20 parts by weight of an alkoxy-containing organosilane compound represented by the general formula $$X_aSiMe_bR_c, \quad \ldots\ldots (I)$$

in which Me is a methyl group, R is an alkoxy group, X is a monovalent group selected from the class consisting of a vinyl group, 3-methacryloxypropyl group and 3-glycidyloxypropyl group, the subscript a is zero or 1, b is zero, 1 or 2 and c is 2 or 3 with the proviso that a+b+c is equal to 4.

DETAILED DESCRIPTION OF THE PREFERRED EMBODIMENTS

Figure 1:
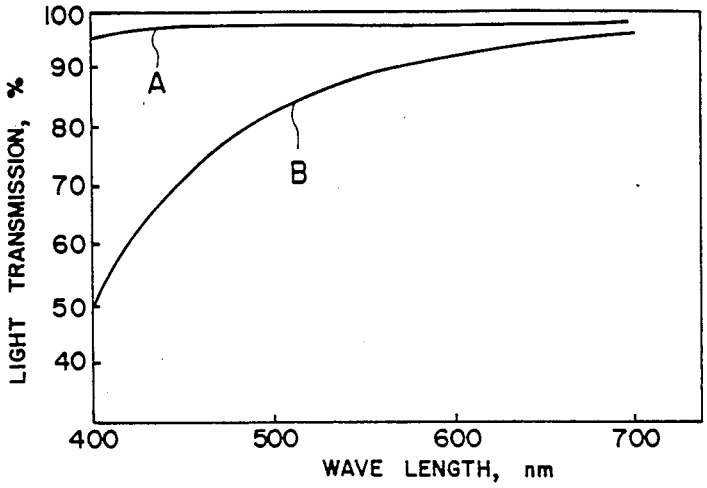
FIGS. 1, 2 and 3 each show the curves of % light transmission in the visible range through layers of 10 mm thickness of the silicone grease compositions prepared in Example 1 (curve A) and Comparative Example 1 (curve B), in Example 7 (curve C) and Comparative Example 2 (curve D) and in Example 8 with (curve E) or without (curve F) the heat treatment.

As is understood from the above given summarizing description, the highly light-transmitting silicone grease composition of the present invention essentially comprises the above defined components (a), (b) and (c) in combination in a specified proportion. By virtue of this unique combination of the components, the silicone grease composition is highly light-transmitting and the light transmission in the visible wave length region through a layer of 10 mm thickness thereof is at least 90%. Moreover, the grease composition is very stable with little separation of the base oil to maintain the consistency over a long period of time. Accordingly, the inventive silicone grease composition is useful in a wide field of applications. For example, the grease composition can be used in the joint of optical-fiber cable for long-distance communication to cause no adverse influences on the light transmission. The grease composition is also used in fluid-sealed cathode ray tubes utilizing the excellent heat- and cold-resistance inherent in silicone greases.

The component (a) as the base oil of the inventive silicone grease composition is a methyl phenyl polysiloxane containing from 5 to 20% by moles of phenyl groups based on the overall amount of the organic groups bonded to the silicon atoms, the rest being methyl groups. The methyl phenyl polysiloxane should be a fluid having a viscosity in the range from 100 to 500,000 centistokes or, preferably, from 500 to 50,000 centistokes at 25° C. When the viscosity thereof is lower than the above mentioned lower limit, no grease composition with stability or with little oil separation can be obtained. When the viscosity is too high, on the other hand, no grease composition with good workability can be obtained.

The component (b), which serves as the thickening agent of the methyl phenyl polysiloxane as the base oil, is a finely divided fumed silica filler. Various grades of such a fumed silica filler are commercially available on the market and any of them can be used in the inventive composition without particular limitations provided that the filler has a specific surface area of at least 130 $m^2/g$ or, preferably, in the range from 130 to 300 $m^2/g$. This limitation is important in order that the silicone grease composition compounded with the filler may have high transparency. The amount of the fumed silica filler added to the methyl phenyl polysiloxane should be determined so that the resultant composition may have a consistency suitable for the intended particular application of the grease but the amount should usually be in the range from 1 to 30 parts by weight or, preferably, from 5 to 20 parts by weight per 100 parts by weight of the methyl phenyl polysiloxane as the base oil. When the amount thereof is smaller than 1 part by weight, the resultant composition can no longer have a consistency as a grease. When the amount is too large, on the other hand, no grease composition with good workability can be obtained.

The component (c) as one of the essential components in the inventive silicone grease composition is an alkoxy-containing organosilane compound represented by the general formula (I) given above. In the formula, the symbol X denotes a monovalent group selected from the class consisting of a vinyl group, 3-methacryloxypropyl group and 3-glycidyloxyporpyl group and R denotes an alkoxy group such as methoxy, ethoxy and methoxyethoxy groups. The subscripts a, b and c are each an integer and a is zero or 1, b is zero 1 or 2 and c is 2 or 3. Exemplary of the alkoxy-containing organosilane compound in conformity with the above definition are: vinyl trimethoxy silane; vinyl methyl dimethoxy silane; vinyl tris(2-methoxyethoxy) silane; 3-methacryloxypropyl trimethoxy silane; 3-glycidyloxypropyl methyl diethoxy silane; dimethyl dimethoxy silane; dimethyl diethoxy silane and the like. The amount of the alkoxy-containing organosilane compound in the inventive silicone grease composition should be in the range from 0.1 to 20 parts by weight or, preferably, from 0.5 to 10 parts by weight per 100 parts by weight of the methyl phenyl polysiloxane as the component (a). When the amount thereof is outside the above mentioned range, no silicone grease composition having desirable properties can be obtained.

The silicone grease composition of the invention can be prepared, in principle, by uniformly mixing the above described components (a), (b) and (c) each in a calculated and weighed amount in a suitable mixing machine such as a planetary mixer. It is sometimes advantageous that the mixing work is performed according to need at an elevated temperature under a reduced pressure followed by further milling on a three-roller mill to effect deaeration. In connection with the order of mixing of these components, especially, when the component (c) is a methyl alkoxy silane having no groups denoted by X, it is preferable in order to obtain a grease composition of a particularly high light transmission that the alkoxy-containing organosilane compound as the component (c) is first mixed with the fumed silica filler as the component (b) and the mixture thereof is subjected to a heat treatment at a temperature in the range, for example, from 50 to 200° C. prior to admixing with the methyl phenyl polysiloxane as the component (a). When such a heat treatment is omitted, absorption of light through the grease composition is somewhat increased, in particular, in the wave length region longer than 525 nm. It is optional that the thus prepared silicone grease composition is further admixed with a fluidity-decreasing agent such as a polyoxyethylene, polyoxypropylene, poly(oxyethylene-oxypropylene) copolymer and the like as well as certain organopolysiloxanes modified with such a polyether moiety conventionally added to silicone grease compositions.

In the following, the silicone grease composition of the invention is illustrated in more detail by way of examples, in which the expression of "parts" always refers to "parts by weight" and the values of viscosity are all those obtained by the measurement at 25° C.

EXAMPLE 1 AND COMPARATIVE EXAMPLE 1.

A light-transmitting silicone grease composition having a consistency of 290 was prepared by mixing 88 parts of a methyl phenyl polysiloxane having a viscosity of 5,000 centistokes and containing 16% by moles of phenyl groups based on the overall amount of the organic groups bonded to the silicon atoms, 12 parts of a fumed silica filler having a specific surface area of 200 $m^2/g$ and 4 parts of vinyl trimethoxy silane using a mixer and then by milling on a three-roller mill followed by deaeration. The light transmission through a 10 mm layer of this composition was 93 to 95% within the wave length region of visible light and practically no oil separation of the composition was noted after 24 hours at 200° C.

Another silicone grease composition was prepared for comparison in the same manner as above excepting the omission of vinyl trimethyoxy silane in the formulation. The grease composition had a consistency of 265 and the light transmission through a layer thereof having a thickness of 10 mm was 90 % or larger in the wave length region longer than 570 nm but smaller than 90 % in the wave length region shorter than 570 nm. The oil separation thereof was 5.4 % after 24 hours at 200° C.

FIG. 1 of the accompanying drawing shows the % light transmission through a 10 mm layer of the above prepared silicone grease compositions either with (curve A) or without (curve B) the admixture of vinyl trimethoxy silane in the ordinate as a function of the wave length in the abscissa.

EXAMPLE 2

A light-transmitting silicone grease composition having a worked consistency of 320 was prepared by mixing 90 parts of a methyl phenyl polysiloxane having a viscosity of 30,000 centistokes and containing 20 % by moles of phenyl groups based on the overall amount of the organic groups bonded to the silicon atoms, 10 parts of a fumed silica filler having a specific surface area of 130 $m^2/g$ and 9 parts of 3-methacryloxypropyl trimethoxy silane using a mixer and then milling on a three-roller mill followed by deaeration. The light transmission through a layer thereof having a thickness of 10 mm was at least 92 % over the whole wave length region of visible light. Practically no oil separation was noted of the grease composition after 25 hours at 200° C.

EXAMPLE 3

A light-transmitting silicone grease composition having a worked consistency of 250 was prepared by mixing 85 parts of a methyl phenyl polysiloxane having a viscosity of 150 centistokes and containing 12.5 % by moles of phenyl groups based on the overall amount of the organic groups bonded to the silicon atoms, 15 parts of a fumed silica filler having a specific surface area of 300 $m^2/g$ and 1 part of 3-glycidyloxypropyl methyl diethoxy silane using a mixer and then milling on a three-roller mill followed by deaeration. The light transmission through a layer thereof having a thickness of 10 mm was at least 90% over the whole wave length region of visible light. Practically no oil separation thereof was noted after 24 hours at 200° C.

EXAMPLE 4

A light-transmitting silicone grease composition having a worked consistency of 310 was prepared by mixing 95 parts of a methyl phenyl polysiloxane having a viscosity of 500,000 centistokes and containing 5 % by moles of phenyl groups based on the overall amount of the organic groups bonded to the silicon atoms, 5 parts of a fumed silica filler having a specific surface area of 380 $m^2/g$ and 1 part of vinyl methyl dimethoxy silane using a mixer and then miling on a three-roller mill followed by deaeration. The light transmission through a layer thereof having a thickness of 10 mm was at least 90 % over the whole wave length region of visible light. Practically no oil separation thereof was noted after 24 hours at 200° C.

EXAMPLE 5

A light-transmitting silicone grease composition having a worked consistency of 300 was prepared by mixing 88 parts of a methyl phenyl polysiloxane having a viscosity of 10,000 centistokes and containing 10 % by moles of phenyl groups based on the overall amount of the organic groups bonded to the silicon atoms, 12 parts of a fumed silica filler having a specific surface area of 200 $m^2/g$ and 4 parts of vinyl tris(2-methoxyethoxy) silane using a mixer and then milling on a three-roller mill followed by deaeration. The light transmission through a layer thereof having a thickness of 10 mm was at least 92 % over the whole wave length region of visible light. Practically no oil separation thereof was noted after 24 hours at 200° C.

EXAMPLE 6

A light-transmitting silicone grease composition having a worked consistency of 200 was prepared by mixing 80 parts of a methyl phenyl polysiloxane having a viscosity of 5,000 centistokes and containing 12.5 % by moles of phenyl groups based on the overall amount of the organic groups bonded to the silicon atoms, 20 parts of a fumed silica filler having a specific surface area of 200 $m^2/g$ and 15 parts of vinyl trimethoxy silane using a mixer and then milling on a threeroller mill followed by deaeration. The light transmission through a layer thereof having a thickness of 10 mm was at least 92 % over the whole wave length region of visible light. Practically no oil separation was noted in the composition after 24 hours at 200° C.

EXAMPLE 7 and COMPARATIVE EXAMPLE 2

A light-transmitting silicone grease composition having a worked consistency of 250 was prepared. Thus, a mixture was prepared by mixing 85 parts of a methyl phenyl polysiloxane having a viscosity of 3,000 centistokes and containing 16 % by moles of phenyl groups based on the overall amount of the organic groups bonded to the silicon atoms, 15 parts of a fumed silica filler having a specific surface area of 380 $m^2/g$ and 10 parts of vinyl trimethoxy silane and the mixture was subjected to a heat treatment at 80° C. for 1 hour and thorough blending under a reduced pressure of 20 mmHg followed by cooling and then to milling on a three-roller mill followed by deaeration. The light transmission through a layer thereof having a thickness of 10 mm was at least 93% over the whole wave length region of visible light. Practically no oil separation thereof was noted after 24 hours at 200° C.

For comparison, another silicone grease composition was prepared in the same manner as above with the same formulation excepting omission of vinyl trimethoxy silane. The light transmission through a layer of this grease composition having a thickness of 10 mm was 90 % or lower over the whole wave length region of visible light and the oil separation thereof was 4.8% after 24 hours at 200° C.

Figure 2:
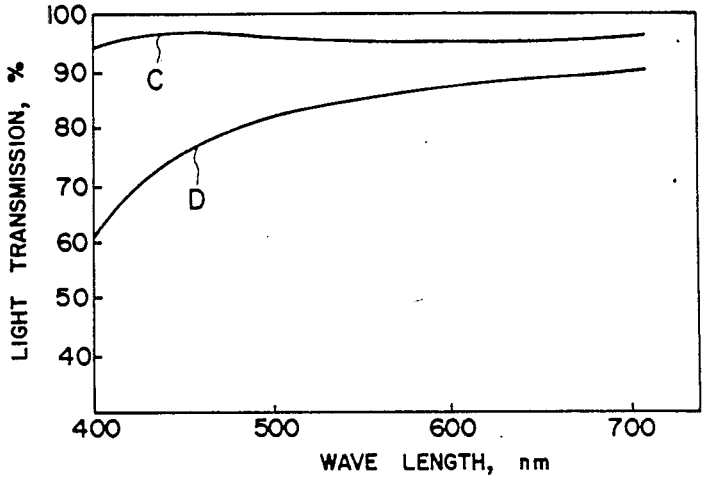

FIG. 2 of the accompanying drawing shows the % light transmission through a 10 mm layer of the above prepared silicone grease compositions either with (curve C) or without (curve D) addition of vinyl trimethoxy silane as a function of the wave length.

EXAMPLE 8

A light-transmitting silicone grease composition having a worked consistency of 370 was prepared by mixing 88 parts of a methyl phenyl polysiloxane having a viscosity of 5,000 centistokes and containing 10% by moles of phenyl groups based on the overall amount of the organic groups bonded to the silicon atoms and 12 parts of a 100:30 by weight mixture of a fumed silica filler having a specific surface area of 200 $m^2/g$ and dimethyl dimethoxy silane having been subjected to a heat treatment at 150° C. for 4 hours and then milling on a three-roller mill followed by deaeration. The light transmission through a layer thereof having a thickness of 10 mm was 95 to 100 % over the whole wave length region of visible light and practically no oil separation thereof was noted after 24 hours at 200° C.

Another silicone grease composition was prepared with the same formulation as above but by merely mixing the three components together followed by milling on a three-roller mill without performing the preliminary heat treatment of the mixture of the fumed silica filler and dimethyl dimethoxy silane. The grease composition had a worked consistency of 290. The light transmission through a layer thereof having a thickness of 10 mm was 56 to 98 % in the wave length region of visible light exhibiting particularly large absorption of light in the wave length region shorter than 525 nm. The oil separation thereof was 15 % after 24 hours at 200° C.

Figure 3:
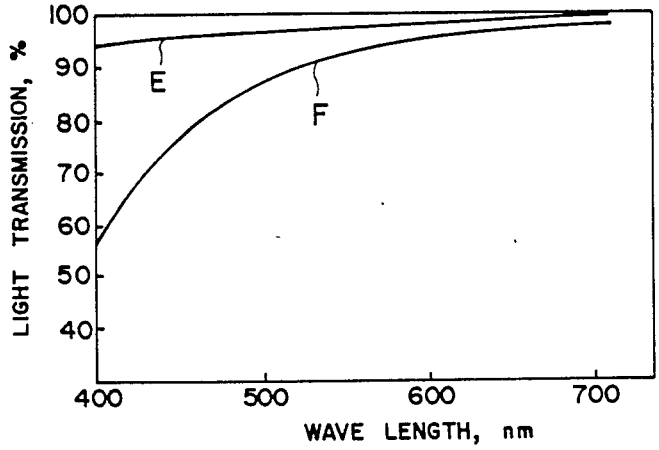

FIG. 3 of the accompanying drawing shows the % light transmission through a 10 mm layer of the above prepared silicone grease compositions either with (curve E) or without (curve F) the preliminary heat treatment of the mixture of the fumed silica filer and dimethyl dimethoxy silane as a function of the wave length.

EXAMPLE 9

A light-transmitting silicone grease composition having a worked consistency of 402 was prepared by mixing 90 parts of a methyl phenyl polysiloxane having a viscosity of 5,000 centistokes and containing 20 % by moles of phenyl groups based on the overall amount of the organic groups bonded to the silicon atoms and 8 parts of a 100:20 by weight mixture of a fumed silica filler having a specific surface area of 380 $m^2/g$ and dimethyl diethoxy silane having been subjected to a heat treatment at 165° C. for 4 hours and then milling on a three-roller mill followed by deaeration. The light transmission through a layer thereof having a thickness of 10 mm was at least 92 % over the whole wave length region of visible light and practically no oil separation thereof was noted after 24 hours at 200° C.

EXAMPLE 10

Ten parts of a fumed silica filler having a specific surface area of 300 $m^2/g$ and 6.6 parts of dimethyl dimethoxy silane were taken and mixed together in a planetary mixer at 150° C. for 5 hours and, after cooling, the mixture was further admixed with 90 parts of a methyl phenyl polysiloxane having a viscosity of 500,000 centistokes and containing 5 % by moles of phenyl groups based on the overall amount of the organic groups bonded to the silicon atoms and milled on a three-roller mill followed by deaeration treatment to give a lighttransmitting silicone grease composition having a worked consistency of 390. The light transmission through a layer thereof having a thickness of 10 mm was at least 90 % over the whole wave length region of visible light and practically no oil separation thereof was noted after 24 hours at 200° C.

EXAMPLE 11

A mixture composed of 100 parts of a fumed silica filler having a specific surface area of 130 $m^2/g$ and 5 parts of dimethyl dimethoxy silane was subjected to a heat treatment at 150° C. for 4 hours under a reduced pressure of 20 mmHg. After cooling, a 25 parts portion of the thus heat-treated mixture was admixed with 75 parts of a methyl phenyl polysiloxane having a viscosity of 150 centistokes and containing 12.5 % by moles of phenyl groups based on the overall amount of the organic groups bonded to the silicon atoms and milled on a three-roller mill followed by deaeration treatment to give a light-transmitting silicone grease composition having a worked consistency of 250. The light transmission through a layer thereof having a thickness of 10 mm was at least 97% over the whole wave length region of visible light. The oil separation thereof was 0.8 % after 24 hours at 200° C.

EXAMPLE 12

A mixture composed of 100 parts of a fumed silica filler having a specific surface area of 200 $m^2/g$ and 6.5 parts of dimethyl diethoxy silane was subjected to a heat treatment at 180° C. for 5 hours and, after cooling, a 15 parts portion of the mixture was admixed with 85 parts of a methyl phenyl polysiloxane having a viscosity of 10,000 centistokes and containing 15 % by moles of phenyl groups based on the overall amount of the organic groups bonded to the silicon atoms and milled on a three-roller mill followed by deaeration treatment to give a light-transmitting silicone grease composition having a worked consistency of 220. The light transmission through a layer thereof having a thickness of 10 mm was at least 96% over the whole wave length region of visible light. Practically no oil separation was noted after 24 hours at 200° C.

What is claimed is:

1. A light-transmitting silicone grease composition which comprises:
   (a) 100 parts by weight of a methyl phenyl polysiloxane having a viscosity in the range from 100 to 500,000 centistokes at 25° C. and containing from 5 to 20 % by moles of phenyl groups based on the overall amount of the organic groups bonded to the silicon atoms;
   (b) from 1 to 30 parts by weight of a fumed silica filler having a specific surface area of at least 130 $m^2/g$; and
   (c) from 0.1 to 20 parts by weight of an alkoxy-containing organosilane compound represented by the general formula $$X_aSiMe_bR_c,$$

in which Me is a methyl group, R is an alkoxy group, X is a monovalent group selected from the class consisting of a vinyl group, 3-methacryloxypropyl group and 3-glycidyloxypropyl group, the subscript a is zero or 1, b is zero, 1 or 2 and c is 2 or 3 with the proviso that a+b+c is equal to 4.

2. The light-transmitting silicone grease composition as claimed in claim 1 wherein the methyl phenyl polysiloxane as the component (a) has a viscosity in the range from 500 to 50,000 centistokes at 25° C.

3. The light-transmitting silicone grease composition as claimed in claim 1 wherein the fumed silica filler as the component (b) has a specific surface area in the range from 130 to 300 $m^2/g$.

4. The light-transmitting silicone grease composition as claimed in claim 1 wherein the alkoxy-containing organosilane compound as the component (c) is selected from the class consisting of vinyl trimethoxy silane, vinyl methyl dimethoxy silane, vinyl tris(2-methoxyethoxy) silane, 3-methacryloxypropyl trimethoxy silane, 3-glycidyloxypropyl methyl diethoxy silane, dimethyl dimethoxy silane and dimethyl diethoxy silane.

5. The light-transmitting silicone grease composition as claimed in claim 1 wherein the amount of the alkoxy-containing organosilane compound is in the range from 0.5 to 10 parts by weight per 100 parts by weight of the methyl phenyl polysiloxane as the component (a).

6. A method for the preparation of a light-transmitting silicone grease composition which comprises the steps of: (a) mixing a fumed silica filler having a specific surface area of at least 130 $m^2/g$ and an alkoxy-containing organosilane compound represented by the general formula $$X_aSiMe_bR_c,$$

in which Me is a methyl group, R is an alkoxy group, X is a monovalent group selected from the class consisting of a vinyl group, 3-methacryloxyporpyl group and 3-glycidyloxypropyl group, the subscript a is zero or 1, b is zero, 1 or 2 and c is 2 or 3 with the proviso that a+b+c is equal to 4;
   (b) subjecting the mixture of the fumed silica filler and the alkoxy-containing organosilane compound to a heat treatment at a temperature in the range from 50 to 200° C.; and
   (c) admixing the thus heat-treated mixture with a methyl phenyl polysiloxane having a viscosity in the range from 100 to 500,000 centistokes at 25° C. and containing from 5 to 20 % by moles of phenyl groups based on the overall amount of the organic groups bonded to the silicon atoms, the amounts of the fumed silica filler and the alkoxy-containing organosilane compound being in the ranges from 1 to 30 parts by weight and from 0.1 to 20 parts by weight, respectively, per 100 parts by weight of the methyl phenyl polysiloxane.

* * * * *